United States Patent [19]

Städele

[11] Patent Number: 4,938,017

[45] Date of Patent: Jul. 3, 1990

[54] APPARATUS FOR AUTOMATIC DOFFING AND DONNING OF TUBES IN A TEXTILE SPINNING OR TWISTING MACHINE

[75] Inventor: Norbert Städele, Göppingen, Fed. Rep. of Germany

[73] Assignee: Zinser Textilmaschinen GmbH, Fed. Rep. of Germany

[21] Appl. No.: 123,171

[22] Filed: Nov. 20, 1987

[30] Foreign Application Priority Data

Nov. 22, 1986 [DE] Fed. Rep. of Germany ..... 3640002

[51] Int. Cl.[5] ..... D01H 9/04

[52] U.S. Cl. ..... 57/274; 57/270; 57/275

[58] Field of Search ..... 57/266, 270, 273–276

[56] References Cited

U.S. PATENT DOCUMENTS

| | | | |
|---|---|---|---|
| 3,772,867 | 11/1973 | Kawakami et al. | 57/274 |
| 3,791,123 | 2/1974 | Kawauchi | 57/274 |
| 4,658,575 | 4/1987 | Lousberg | 57/274 |

FOREIGN PATENT DOCUMENTS

| | | |
|---|---|---|
| 0143770 | 6/1985 | European Pat. Off. . |
| 250222 | 8/1912 | Fed. Rep. of Germany . |
| 1180285 | 6/1965 | Fed. Rep. of Germany . |
| 1785217 | 8/1971 | Fed. Rep. of Germany. . |
| 2026542 | 1/1972 | Fed. Rep. of Germany . |
| 345279 | 4/1960 | Switzerland . |
| 434038 | 10/1967 | Switzerland . |
| 644905 | 8/1984 | Switzerland . |

*Primary Examiner*—John Petrakes

*Attorney, Agent, or Firm*—Shefte, Pinckney & Sawyer

[57] ABSTRACT

A method and apparatus for automatically doffing fully wound bobbins simultaneously from the plural spindles of a textile spinning or twisting machine and subsequently donning empty tubes simultaneously onto the spindles. When doffing a fully wound bobbin from its supporting spindle, a trailing length of yarn from the doffed bobbin is helically placed about the spindle and, when subsequently donning an empty tube onto the spindle, the trailing yarn length is securely clamped at least partially between the empty tube and spindle, which trailing yarn length is automatically broken from the doffed bobbin upon its removal, to enable convenient automatic re-start of the machine. A respective gripping arrangement, having a pair of gripper assemblies, is associated with each spindle with a common drive being provided for the gripping arrangements to selectively position each pair of gripper assemblies alternately in position for alignment with the associated spindle for doffing and donning operation and another position spaced therefrom.

16 Claims, 4 Drawing Sheets

Figure 1:
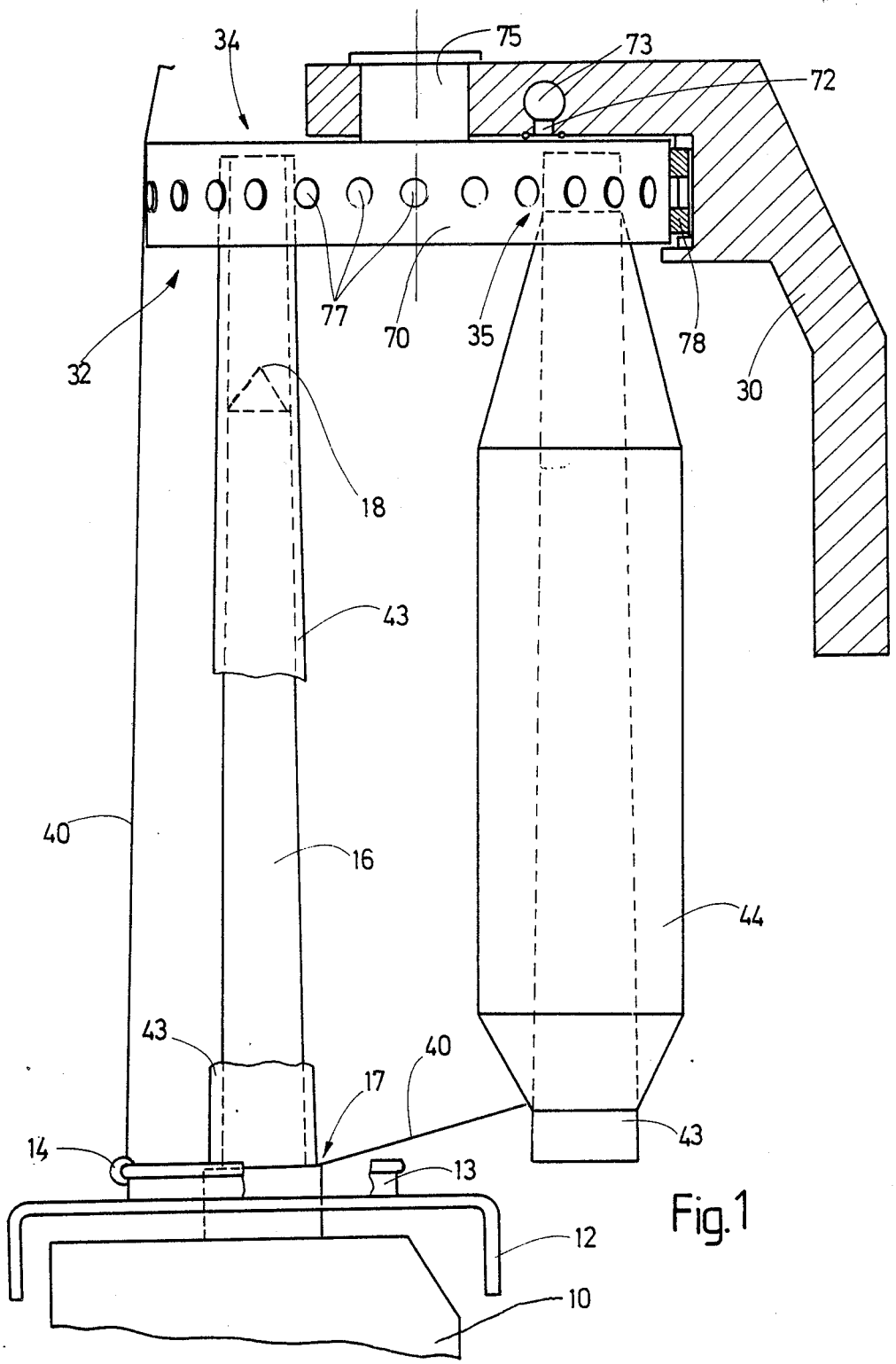

APPARATUS FOR AUTOMATIC DOFFING AND DONNING OF TUBES IN A TEXTILE SPINNING OR TWISTING MACHINE

BACKGROUND OF THE INVENTION

The present invention relates generally to textile spinning or twisting machines or like apparatus and, more particularly, to a method and apparatus for use with such machines for the automatic simultaneous doffing from the machine spindles of tubes fully wound with yarn and the subsequent simultaneous donning of empty tubes onto the spindles.

As is known, textile spinning or twisting machines typically have a machine frame on which a plurality of spinning stations each having a tube-supporting spindle are longitudinally arranged. A transport arrangement may be provided to extend longitudinally along the machine frame for delivering empty tubes for donning onto the spindles and for removing fully wound tubes, often referred to as "bobbins," doffed from the spindles. A gripper beam may be provided in association with the transport arrangement for accomplishing the doffing and donning operation. Specifically, the gripper beam extends longitudinally along the machine frame and includes a plurality of gripper arrangements respectively associated with the plural spinning stations for gripping engagement of fully wound tubes and empty tubes for doffing and donning thereof. The gripper beam is selectively positionable at the spindles and at the transport arrangement and is operated by a control system for successively removing empty tubes from the transport arrangement, doffing fully wound tubes from the spindles, donning the empty tubes onto the spindles, and transferring the doffed tubes to the transport arrangement.

A representative doffing and donning apparatus and method of the above-described type is disclosed in West German Patentschrift No. 17 85 217, which discloses a textile spinning machine of the type having a plurality of adjacent spinning stations at each of which a roving is drawn through a drafting mechanism and subsequently spun as a yarn and wound onto a supporting tube driven by a machine spindle. Once the tubes at each spinning station have been fully wound with yarn to form bobbins, the bobbins are simultaneously doffed from all of the machine spindles and, thereafter, empty tubes are likewise donned simultaneously onto the spindles by a gripper beam of the aforementioned type having a plurality of gripper arrangements respectively associated with the plural spinning stations. In this apparatus and method, each gripper arrangement is provided with a pair of gripper assemblies disposed one behind the other in a plane essentially perpendicular to the longitudinal extent of the machine. A transport arrangement travels longitudinally along the machine beneath the spindles for delivering empty tubes for donning and removing doffed fully-wound bobbins. In order to replace a full bobbin with an empty tube, the gripper beam is positioned at the transport arrangement and the gripping assembly adjacently facing the machine frame in each gripper arrangement is operated to remove an empty tube from the transport arrangement. The gripper beam is then moved to a disposition at the spindles and the other free gripper assembly of each gripper arrangement engages and doffs the fully-wound bobbin from the respective spindle. As will be understood, during this procedure, the empty tube held by the first gripping assembly while awaiting donning is located between the doffed fully-wound bobbin and the machine frame. Next, the gripper beam is shifted perpendicularly to the longitudinal extent of the machine to position the empty tube over the spindle, whereupon the tube is donned onto the spindle. The gripper beam is then returned to the transport arrangement and the fully-wound bobbins doffed from the plural spindles are transferred to the transport arrangement.

Thus, the entire doffing and donning process as described is accomplished by essentially straight-line movements of the gripper beam transversely to the longitudinal extent of the machine. As will be understood, such movements require an extremely precise control of the drive mechanism for the gripper beam which necessarily is relatively expensive. Moreover, in the doffing and donning process as described, the spindles must be horizontally spaced from the machine frame a distance at least sufficient to enable the empty tubes to be moved between the spindles and the machine frame for donning.

Great Britain Patent No. 836,815 discloses another doffing and donning apparatus for spinning machines which similarly provides a plurality of gripper arrangements, each having a pair of gripper assemblies, respectively associated with the plural spinning stations of the machine. However, in this apparatus, each gripper arrangement is mounted for rotation about a horizontal axis for performing the doffing and donning operations. Necessarily, this rotatable mounting requires a considerable amount of space as well as a relatively expensive control mechanism. Additionally, to facilitate re-starting of the spindles following a doffing and donning operation, the yarn at each spinning station is wound onto a base area of the respective spindle before the spinning machine is stopped for the doffing and donning operation. A triangular stripping element is utilized at each spinning station to prevent the yarn from being clamped between the empty tube and the spindle when the empty tube is donned onto the spindle. Thus, the underwindings of the yarn permit the spinning machine to be automatically re-started after a doffing and donning operation. However, disadvantageously, individual yarn underwindings normally remain as waste on the bobbins, which underwindings usually must be removed by hand.

SUMMARY OF THE INVENTION

It is accordingly an object of the present invention to provide a method and apparatus for automatic simultaneous doffing of fully-wound bobbins and subsequent simultaneous donning of empty tubes onto the spindles of a textile spinning or twisting machine wherein the entire doffing and donning operation is performed as rapidly as possible and wherein an automatic re-starting of the spinning machine is facilitated after a doffing and donning operation without a need for any manual cleaning operation.

For this purpose, the method and apparatus of the present invention are adapted to a textile spinning or twisting machine or like apparatus of the aforedescribed type having a machine frame, a plurality of spinning stations each having a tube-supporting spindle longitudinally arranged along the frame, a transport arrangement extending longitudinally along the machine frame for delivering empty tubes for donning on the spindles and removing tubes fully wound with yarn doffed from stations arranged in alignment longitudinally along the length of the spinning machine.

A yarn tube 43 is "donned," i.e. supported telescopically, on the spindle 16, resting on a shoulder 17 of the spindle 16. The yarn tube 43 and the spindle 16 are respectively tapered at differing taper angles, with the spindle 16 in the area of its tip 18 radially engaging the interior of the tube 43 by a tube-securing device (not shown).

For winding a yarn 40 onto the tube 43, the spindle 16 with the "donned" tube 43 is drivenly rotated in conventional manner while the ring rail 12 is driven upwardly and downwardly along the spindle 16 in parallel relation therewith to progressively wind the yarn 40 about the length of the tube 43, to ultimately form a "bobbin" 44 fully wound with the yarn 40.

An automatic tube replacement apparatus is provided for simultaneously doffing full bobbins 44 from the spindles 16 at each spinning station of the ring spinning machine and subsequently donning empty tubes 43 simultaneously onto the spindles 16. The doffing and donning apparatus basically includes a gripper beam 30 which extends longitudinally along the ring spinning machine, with a plurality of gripper arrangements 32 supported at spacings along the gripper beam 30, each gripper arrangement 32 being associated with a respective one of the spinning stations of the ring spinning machine. Each gripper arrangement 32 is provided with two gripper assemblies 34,35, the position of which may be selectively varied relative to the gripper beam 30 by means of a common adjusting drive arrangement 37 to which each gripper arrangement 32 is drivenly connected.

Each gripper arrangement 32 includes a rotary disk 70 rotatably mounted on the gripper beam 30 about a vertical shaft 75. Each rotary disk 70 has a plurality of pins 77 formed at equal spacings about the outer peripheral circumference of the disk 70. The common adjusting drive arrangement 37 includes a drive band or belt 78 compatibly formed with equally spaced perforations along its length for positive drive engagement with the pins 77 of each rotary disk 70. The drive band 78 is guided by the gripper beam 30 for reciprocal back-and-forth driven motion longitudinally with respect to the spinning machine by an associated drive arrangement, such as pneumatic cylinders, for driving corresponding reciprocal rotation of the rotary disk 70 of each gripper arrangement 32.

The shaft 75 for the rotary disk 70 of the plural gripping arrangements 32 are arranged along the gripper beam 30 at longitudinal spacings to one another corresponding to the spacing of the spindles 16 of the ring spinning machine. As aforementioned, the total number of the rotary disks 70 corresponds to the total number of spinning stations of the machine. The diameter of each rotary disk 70 is smaller than the spacings between the spindles 16. The plural shafts 75 to the rotary disks 70 are located in a common generally vertical plane essentially parallel to the longitudinal direction of the machine and parallel to another vertical plane common to all of the spindles 16.

Each rotary disk 70 supports the associated pair of gripper assemblies 34,35 of its gripper arrangement 32. The gripper assemblies 34,35 of each gripper arrangement 32 are substantially identical in construction and are mounted to their respective rotary disks 70 at a 180 degree offset from one another at diametrically opposite sides of the respective supporting shaft 75.

Each gripper assembly 34,35 includes a vertical opening 50,60 defined in the respective rotary disk 70, the openings 50,60 being generally circular with two guide tabs 51,61 projecting radially inwardly from the outer peripheral circumference of the openings. The diameter of each opening 50,60 is greater than the outer diameter of the upper tapered end of a tube 43. The axial centers of the openings 50,60 of each rotary disk 70 are spaced from one another only slightly greater, e.g. 5 to 10 millimeters greater, than the sum of the maximum radii of a fully-wound bobbin 44 and of an empty tube 43. The guide tabs 51,61 are circumferentially offset from one another approximately 120 degrees, with each gripper assembly 34,35 including an associated clamping element 54,64 circumferentially intermediate the guide tabs 51,61 at a corresponding 120 degree circumferential spacing from each thereof. Each clamping element 54,64 is preferably a piston member guided by an extension portion 55,65 for reciprocable movement within a bore 53,63 in its respective rotary disk 70. A coil spring 56,66 is disposed telescopically within the extension portion 55,65 of each piston 54,64 and extends therefrom into engagement with the end surface of the bore 53,63, thereby to bias the piston 54,64 into a clamping disposition projecting into the respective opening 50,60.

Each piston 54,64 is provided with an annular collar disposed in an enlarged area of the respective bore 53,63 wherein an annular expansible bellows 57,67 is also disposed in sealed peripheral engagement with the piston 54,64. Each rotary disk 70 is provided with fluid supply openings 59,69 in the top surface thereof at diametrially opposite sides of the shaft 75, which openings 59,69 communicate through fluid supply passageways 58,68 extending through the respective rotary disk 70 into respective communication with the enlarged areas of the bores 53,63 for fluid communication with the bellows 57,67.

Figure 2:
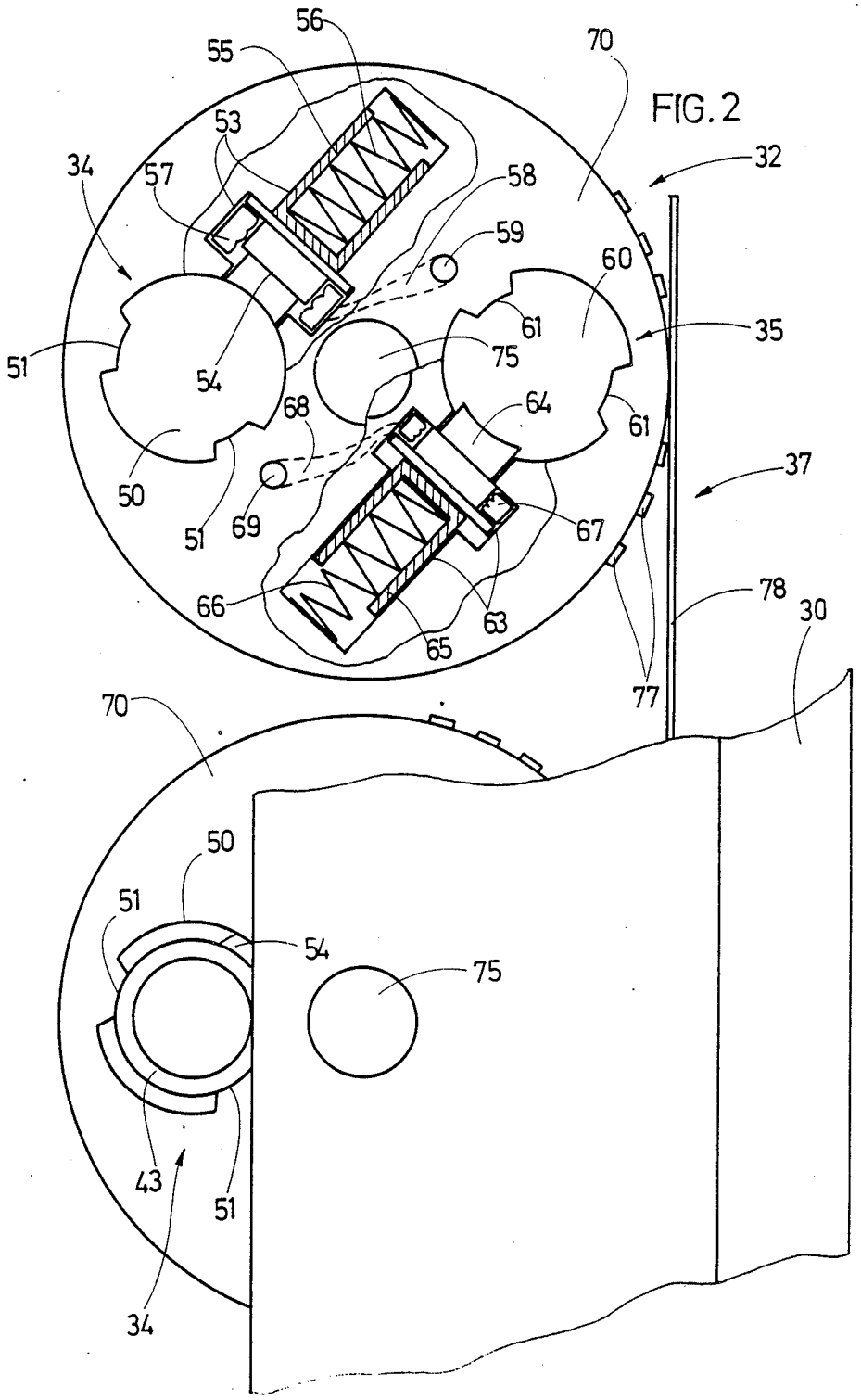

Each gripper assembly 34,35 is thusly adapted to clampingly grip the outer circumferential periphery of a tube 43 at its tapered upper end. As will be recognized, for this purpose, each piston 54,64 may be moved by its biasing spring 56,66 into a clamping disposition to hold a tube 43 within the respective opening 50,60 between the piston 54,64 and the associated guide tabs 51,61. The guide tabs 51,61 and the associated piston 54,64 of each gripper assembly 34,35 are configured to conform to the circular periphery of the tubes 43 and may optionally be provided with a rubber support or similar cushioning surface to avoid damage to the tubes 43. By way of example, a tube 43 as clamped by a piston 54 of a gripper assembly 34 is shown in the lower rotary disk 70 in FIG. 2. The piston 54,64 of a gripper assembly 34,35, may be actuated pneumatically into a disengaged position against the biasing force of the associated spring 56,66 by conveyance of compressed air into the associated bellows 57,67 through the associated passageway 58,68 as more fully described hereinafter. By way of example, the leftmost gripper assembly 34 in the upper rotary disk 70 of FIG. 2 is shown with its bellows 57 expanded to retract the associated piston 54 into a withdrawn non-clamping position, while the rightmost gripper assembly 35 is shown in its clamping position with its bellows 67 deflated to permit its associated piston 64 to project into the opening 60 under the biasing force of its spring 66.

As may be seen in FIG. 1, the top surface of each rotary disk 70 and the undersurface of the gripper beam 30 extend parallel to one another at a slight spacing. A lengthwise passageway 73 extends longitudinally through the gripper beam 70, with a transverse downward opening 72 being formed to open to the undersurface of the gripper beam 30 at each spinning station. Each opening 72 in the gripper beam 30 is surrounded by a sealing ring fitted in an annular groove about the opening 72 in sealing contact with the top surface of the associated rotary disk 70. Each opening 72 is formed at a spacing from the shaft 75 of the associated rotary disk 70 corresponding to the radial spacing of the openings 59,69 in the disk 70 from its shaft 75, to enable each opening 59,69 to be brought alternately into communication with the respective opening 72 upon rotation of the rotary disk 70. Additionally, each opening 72 is formed at a selected position to communicate with the opening 59 or 69 of the gripper assembly 34 or 35 of the associated rotary disk 70 which at any given time is rotationally positioned for alignment with the associated spindle 16.

The passageway 73 through the gripper beam 30 is connected to a regulatable source of supply of compressed air. In the disposition of a rotary disk 70 shown by the upper rotary disk 70 in FIG. 2, the opening 50 of the gripper assembly 34 is disposed for alignment with the associated spindle 16, as hereinafter described. In this position, the passageway opening 59 is aligned with the respective opening 72 in the gripper beam 30 to bring the annular bellows 57 into communication with the supply passageway 73 through the operating passageway 58 in the disk 70, permitting the bellows 57 to be expanded with compressed air to retract the gripper assembly 34 into a non-clamping disposition against the biasing force of its associated spring 56 by means of appropriate control of the compressed air source. As will be understood, in this retracted disposition of the gripper assembly 34, the upper end of a tube 43 may be introduced into or removed from the opening 50. On the other hand, if compressed air is not supplied to expand the annular bellows 57, the biasing spring 56 operates to urge the piston 54 into clamping disposition projecting into the opening 50, whereby a tube 43 introduced into the opening 50 will be held fast.

Referring now to FIGS. 3A through 3F, the method of the present invention for automatically replacing full bobbins 44 with empty tubes 43 simultaneously at all spinning stations will be understood. The gripper beam 30 is supported on an extension device 25 which is pivoted about a longitudinal shaft 27 for pivotable movement in the direction of arrow 47 seen in FIG. 3E and for extensible and retractible movement perpendicularly with respect to the pivot shaft 27 in the direction of arrow 46 also seen in FIG. 3E. Respective drives are provided for actuating the pivoting and extension/retraction movements of the extension device 25. The rotatability of the rotary disks 70 on the gripper beam 30 is additionally indicated schematically in FIG. 3E by the arrow 48. The aforementioned spindle bearing plate 10 of the ring spinning machine is mounted to the machine frame 20 which extends along the side of the spindles 16 opposite the gripper beam 30. A transport arrangement 22 extends longitudinally along the machine frame beneath the spindle bearing plate 10 (FIG. 3B). The transport arrangement 22 is preferably a conveyor belt having a plurality of tube support elements 23 at least equal in number to the total number of spinning stations and being spaced along the length of the transport arrangement 22 in correspondence to the spacings of the spindles 16. The transport arrangement 22 is adapted for driven movement to move the tube support elements 23 longitudinally along the machine frame 20, thereby to deliver empty tubes 43 to the spinning stations and remove fully wound bobbins 44 therefrom.

The gripper beam 30 may be manipulated by the extension device 25 to be selectively positioned at the spindles 16 and at the transport arrangement 22. The gripper assemblies 34,35 of each gripper arrangement 32 may be rotatably positioned relative to the associated spindles 16 and the associated tube support elements 23 alternately into a first position wherein the gripper assemblies 34,35 are positioned for alignment with the associated spindles 16 or with the associated tube support elements 23 immediately co-axially thereabove and a second waiting position wherein the gripper assemblies 34,35 are spaced from the first position away from the machine frame out of possible alignment with the spindle 16 or the tube support elements 23.

FIG. 3A illustrates the initial starting position of the gripper beam 30 and extension device 25 in beginning a doffing and donning operation. In this disposition, the gripper beam 30 initially grips each empty tube 43 on the transport arrangement 22 with the gripper assembly 34 of the plural gripper arrangements 32 and doffs the empty tubes 43 upwardly from the transport arrangement 22. The gripper beam 30 is then moved to adjacent the fully wound bobbins 44 on the spindles of the machine by manipulating the extension device 25 to pivot about the shaft 27, as indicated by the arrow 47, and to extend upwardly, as indicated by the arrow 46. As this manipulation of the gripper beam 30 is accomplished, the rotary disks 70 of the gripper arrangements 32 are rotated through 180 degrees, as indicated by the arrow 48, to position the gripper assemblies 44 with the empty tubes 43 in the waiting position and the free gripper assemblies 35 in the aligned position. This described operation is depicted in FIG. 3B which shows the gripper beam 30 in its pivoted state during its manipulation from the transport arrangement 22 to the spindles, with the rotary disk 70 shown as already rotated.

The spinning operation of the ring spinning machine is stopped by no later than the completion of the positioning of the gripper beam 30 at the bobbins 44 on the spindles 16. Prior to stoppage, the ring rail 12 at each spinning station of the machine is operated to place a series of windings of a trailing length of each yarn 40 either about the lower base area of the spindles 16, which area is provided with a relatively smooth surface, or about the lower base area of the tubes 43 of the fully wound bobbins 44 or alternatively onto the lower conical portion of the yarn wound on the bobbins 44. When the ring spinning machine has fully stopped, the gripper assemblies 35 of each gripper arrangement 32 are operated to grip the upper ends of the tubes 43 of the fully wound bobbins 44, during which process the empty tubes 43 previously gripped within the griper assemblies 34 are disposed in the waiting position at the side of the spindles 16 away from the machine frame 20, all as depicted in FIG. 3C.

Next, as shown in FIG. 3D, the gripper beam 30 is moved vertically upwardly to doff the fully wound bobbins 44 from the spindles 16, during which operation the trailing end 41 of each yarn 40 previously wound just before the stoppage of the ring spinning machine is drawn helically over the respective spindle 16. When the bobbins 44 are free of the spindles 16, the rotary disks 70 are again rotated 180 degrees to position the empty tubes 43 held in their respective gripper assemblies 34 in aligned disposition with the spindles 16. The trailing length 41 of each yarn 40 produced in advance of the machine stoppage is formed of a selected length to avoid any breakage of the yarns 40 during the upward movement of the gripper beam 30 and the rotational movement of the rotary disks 70.

Following rotational movement of the rotary disks 70, the empty tubes 43 in the aligned position are donned onto the spindles 16 by vertically downward movement of the gripper beam 30. The helical windings of the trailing length 41 of each yarn 40 are thereby clamped fast at least partially between the respective tubes 43 and spindles 16 by this donning operation. With reference again to FIG. 1, an empty tube 43 is shown in donned disposition on the spindle 16 with the trailing length 41 of yarn 40 being clamped between the empty tube 43 and spindle shoulder 17 and extending therefrom to the doffed fully wound bobbin 44. While the trailing yarn length 41 is shown relatively taut, it will be understood that the trailing yarn length 41 may also sag somewhat between the empty tube 43 and the doffed bobbin 44 depending on the amount of the trailing yarn length actually clamped.

After donning of the empty tubes 43 to clamp the yarns 40, the gripper assemblies 34 of the gripper devices 32 are operated to release the empty tubes and the gripper beam 30 is then moved with the full bobbins 44 back to the starting disposition at the transport arrangement 22. During this movement, the rotary disks 70 are again rotated 180 degrees to move the gripper assemblies 35 and the bobbins 44 clamped therein from the waiting position into the aligned position to be aligned with the tube support element 23 when the movement is completed. As will be understood, the pivoting and retracting movement of the extension device 25 necessary to accomplish return of the gripper beam 30 to the transport arrangement 22, together with the rotation of the rotary disks 70, combine to cause the trailing yarn lengths 41 to be broken automatically from the doffed bobbins 44. These aspects of the present method are depicted in FIG. 3E.

FIG. 3F shows the gripper beam 30 at the completion of its return to the starting disposition at the transport arrangement 22, with the gripper assemblies 35 holding the fully wound bobbins 44 in coaxial alignment with the tube support elements 23. The bobbins 44 are transferred to the transport arrangement 22 by vertically lowering the gripper beam 30 to position the bobbins 44 coaxially on the support elements 23, followed by the subsequent operation of the gripper assemblies 35 to release the bobbins 44. Thereupon, the extension device 25 returns the gripper beam 30 to the original starting position of FIG. 3A, whereupon the doffing and donning process is concluded. The ring spinning machine may be re-started at the latest by this point in time, whereupon each yarn 40 clamped between the respective empty tube 43 and supporting spindle 16 begins to be wound automatically onto the tube 43 by the conventional operation of the ring rail 12 aforedescribed.

With yarns 40 of a relatively high strength, a separate yarn breaking device may be utilized for breaking the trailing yarn length 41 between a doffed bobbin 44 and the empty donned tube 43. The operation of the breaking device may advantageously be performed immediately after the donning of the empty tubes 43 onto the spindles 16.

Figure 4:
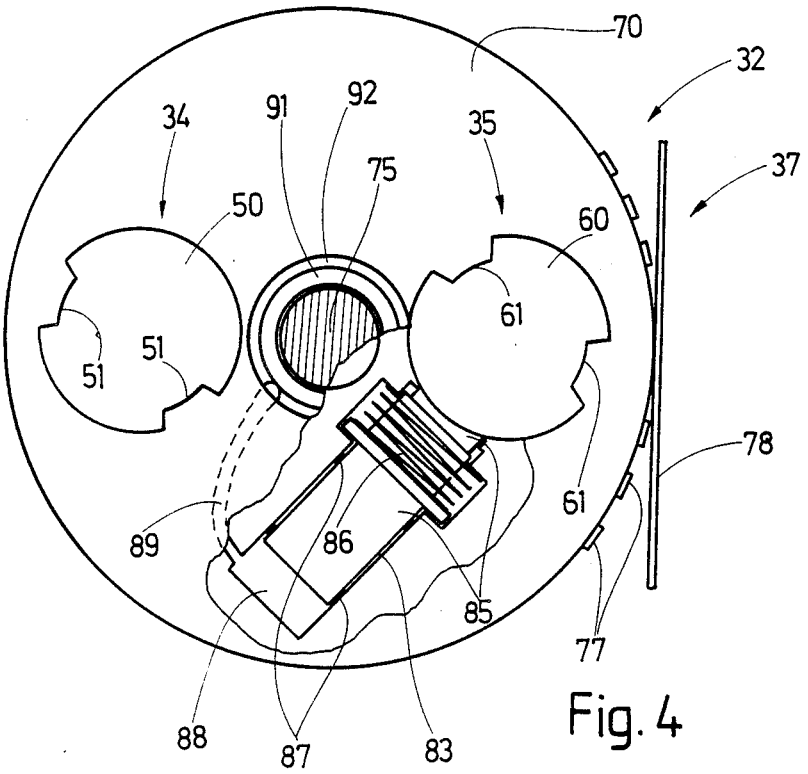
Figure 5:
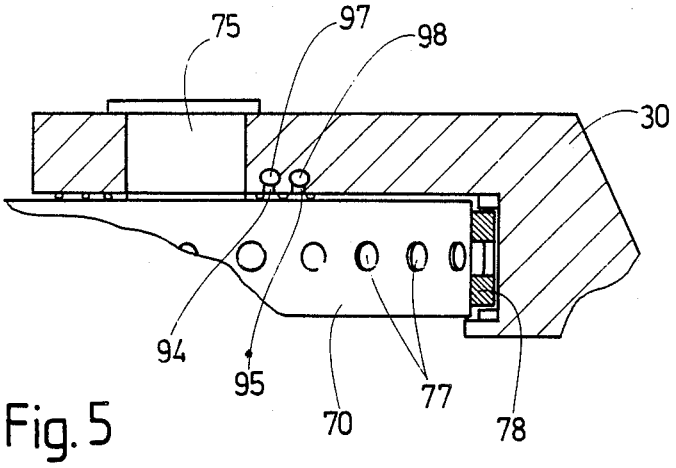

With reference now to FIGS. 4 and 5, an alternate embodiment of the gripping arrangement 32 is shown which differs essentially from the embodiment of FIGS. 1 and 2 in that the gripping assemblies 34,35 are biased into non-clamping disposition by means of biasing springs 86 and are actuated pneumatically into clamping disposition. Additionally, the gripper assemblies 34,35 of this embodiment may be actuated in any rotational disposition of the associated rotary disks 70. Since the gripper assemblies 34,35 in this embodiment are identically designed, only the gripper assembly 35 is illustrated in the drawings and described herein, it being understood that the gripper assembly 34 is of the same construction and operation.

In this embodiment, each gripper assembly 34,35 includes a piston clamping element 85 reciprocably mounted in a bore 83 for movement radially with respect to the associated opening 50,60 in the respective rotary disk 70. Coil springs 86 are disposed in an enlarged region of each bore 83 to bias the associated piston 85 into a retracted position withdrawn from the openings 50,60. Sealing rings 87 are fitted in each bore 83 rearwardly from the enlarged region thereof to sealably enclose the inward end of the bore 83. Each bore 83 communicates through a passageway 89 formed in the associated rotary disk 70 with a respective annular groove 91,92 formed concentrically to the rotary shaft 75 at the top surface of the rotary disk 70 by three sealing rings (FIG. 5) in sealing engagement between the upper rotary disk surface and the undersurface of the gripper beam 30.

Two longitudinal passageways 97,98 are formed lengthwise through the gripper beam 30, with each passageway 97,98 communicating in the area of each rotary disk 70 through a respective opening 94,95 with a respective one of the annular grooves 91,92. The passageways 97,98 are adapted to be connected with a source of compressed air which may thereby be delivered through the openings 94,95, the annular grooves 91,92, and the passageways 89 into the respective piston bores 83 to actuate reciprocal movement of the pistons 85 against the biasing force of their respective springs 86 into clamping disposition projecting radially inwardly into their respective openings 50,60. As will be understood, this operation of the pistons 85 may be accomplished at any rotational disposition of the rotary disk 70. When compressed air is not being supplied to the piston bores 83, the springs 86 operate to retract the pistons 85 into non-clamping disposition within their bores 83.

The bobbin replacement operation of the embodiment of FIGS. 4 and 5 may be understood with reference again to the schematic FIGS. 3A through 3F. As with the embodiment of FIGS. 1 and 2, the transport arrangement 22 is located vertically beneath the spindles 16 with the tube supporting elements 23 vertically beneath and coaxial with the spindles 16. On the other hand, it is possible to locate the spindles 16 and the tube supporting elements 23 at a relative vertical offset from one another equivalent to the spacing of the gripper assemblies 34,35. As will thus be understood, if the tube supporting elements 23 of the transport arrangement 22 are offset vertically with respect to the spindles 16 in the direction outwardly away from the machine frame 20, then the rotary disks 70 are required to execute only a single rotary motion to accomplish a complete doffing and donning operation. Specifically, rotary operation of the rotary disk 70 would be required only when the full bobbins 44 are doffed from the spindles 16 in order to bring the empty tubes 43 into donning alignment over the spindles 16. For this operation, the gripper assemblies 34,35 must be capable of gripping and releasing actuation in both their aligned and waiting positions, which capability is provided as aforedescribed by the embodiment of FIGS. 4 and 5. In contrast, to provide this capability in the embodiment of FIGS. 1 and 2, it would be necessary to provide an additional fluid supply passageway through the gripper beam for fluid communication with the gripper assembly 34,35 located at any given movement in the waiting position.

As will thus be understood, the present invention provides a simple mechanical design for accomplishing the necessary gripping and releasing of yarn tubes for doffing and donning operations, while also enabling precise positioning of tubes with respect to the spindles of the spinning machine and the tube support elements of the transport arrangement. Additionally, the selective positionability of the gripper assemblies of each gripper arrangement in the present invention enables the spinning machine to be designed with the spacing between its spindles and the machine frame selected solely as a function of the maximum desired diameter of fully wound bobbins. In the embodiment of FIGS. 1 and 2, only a single source of compressed air is required to accomplish control of the two gripper assemblies of each gripper arrangement since at any given time only one of the gripper assemblies must be supplied with compressed air in order to grip or release a yarn tube. Further, in case of the failure of the compressed air, tubes clamped by the gripper assemblies will continue to be held thereby under the biasing force of the piston springs. On the other hand, the embodiment of FIGS. 4 and 5 provides the advantage of enabling operation of either gripper assembly at any rotational disposition thereof, permitting the spinning machine and the associated transport arrangement to be relatively positioned to require only a single movement of each gripping arrangement to accomplish a complete doffing and donning operation as aforedescribed, which enables the further simplification of the tube replacement process.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a textile spinning or twisting machine or like apparatus of the type having a machine frame, a plurality of spinning stations each having a tube-supporting spindle longitudinally arranged along the frame, transport means extending longitudinally along the machine frame for delivering empty tubes for donning on the spindles and removing tubes fully wound with yarn doffed from the spindles, a gripper beam extending longitudinally along the machine frame with a plurality of gripper means respectively associated with the spinning stations for gripping engagement of fully wound tubes and empty tubes for doffing and donning thereof, each gripper means including a pair of gripper assemblies, the gripper beam being selectively positionable at the spindles and the transport means, and means for controlling the gripper beam and gripper means for successively removing empty tubes from the transport means, doffing fully wound tubes from the spindles, donning the empty tubes onto the spindles, and transferring the doffed tubes to the transport means, apparatus for automatically doffing fully wound tubes simultaneously from the spindles and subsequently donning empty tubes simultaneously onto the spindles, said apparatus comprising a common drive means for the plurality of gripper means for selectively positioning each pair of gripper assemblies relative to the gripping beam alternately in a first position for alignment with respectively associated spindle for doffing and donning operation with respect thereto and a second position spaced from the first position away from the machine frame.

2. Apparatus according to claim 1 and characterized further in that each gripper means is rotatably mounted about a respective vertical shaft with the respective gripper assemblies disposed at equal spacings from the shaft.

3. Apparatus according to claim 2 and characterized further in that the gripper assemblies of each gripper means are disposed at diametrically opposite sides of their respective shaft.

4. Apparatus according to claim 2 and characterized further in that the gripper assemblies are spaced from one another a distance only slightly greater than the sum of the maximum outer radii of a fully-wound tube and an empty tube.

5. Apparatus according to claim 2 and characterized further in that the respective vertical shafts of the gripper means are disposed in a common vertical plane essentially parallel to a vertical plane common to the spindles.

6. Apparatus according to claim 2 and characterized further in that each gripper means includes a rotary disk on which the respective gripper assemblies are arranged, the rotary disk being mounted rotatably on the gripper beam in driven engagement with the common drive means.

7. Apparatus according to claim 6 and characterized further in that each rotary disk and the common drive means include compatible means for positive driving engagement therebetween.

8. Apparatus according to claim 7 and characterized further in that each rotary disk includes a peripheral arrangement of drive pins and the common drive means includes a drive band compatibly perforated for positive driving engagement with the drive pins, the drive band being driven to travel longitudinally along the machine frame.

9. Apparatus according to claim 1 and characterized further in that each gripper assembly is adapted for gripping engagement with an upper end of an associated tube.

10. Apparatus according to claim 9 and characterized further in that each gripper assembly includes means for clamping the associated upper tube end.

11. Apparatus according to claim 10 and characterized further in that each gripper assembly defines an opening of a larger dimension than the associated upper tube end and the clamping means includes a clamping element selective movable into and out of the opening for clamping engagement with the associated upper tube end.

12. Apparatus according to claim 11 and characterized further in that the clamping means includes a biasing spring and drive means for moving the clamping element against the biasing operation of the spring.

13. Apparatus according to claim 12 and characterized further in that the spring of each clamping means is arranged for biasing the clamping element into the defined opening in a tube clamping disposition.

14. Apparatus according to claim 13 and characterized further in that each gripper means includes a rotary disk on which the respective gripper assemblies are arranged, the rotary disk being mounted rotatably on the gripper beam in driven engagement with the common drive means, each clamping element being a piston reciprocably mounted to the respective rotary disk and each rotary disk defining a fluid operating passageway associated with each respective piston, the gripper beam having a fluid supply passageway for communicating with a source of compressed air with a fluid supply opening at each rotary disk, the operating passageways being arranged on each rotary disk for alternately communicating with the supply passageway opening for receiving compressed air therefrom for actuating movement of the associated piston into a non-clamping position against the biasing force of the associated spring.

15. Apparatus according to claim 12 and characterized further in that the spring of each clamping means is arranged for biasing the clamping element out of the defined opening away from a tube clamping disposition.

16. Apparatus according to claim 15 and characterized further in that each gripper means includes a rotary disk on which the respective gripper assemblies are arranged, the rotary disk being mounted rotatably on the gripper beam in driven engagement with the common drive means, each clamping element being a piston reciprocably mounted to the respective rotary disk and each rotary disk defining a pair of annular fluid operating passageways coaxial therewith and each associated with a respective one of the pistons, the gripper beam having a pair of fluid supply passageways for communication with a source of compressed air and each opening to a respective one of the annular passageways at each rotary disk for selectively actuating movement of each piston into a clamping position against the biasing force of the associated spring.

* * * * *

United States Patent [19]

Stalder et al.

[11] Patent Number: 4,938,018

[45] Date of Patent: Jul. 3, 1990

[54] FRICTION SPINNING MACHINE

[75] Inventors: Herbert Stalder, Kollbrunn; Josef Baumgartner, Sirnach, both of Switzerland

[73] Assignee: Rieter Machine Workds, Ltd., Winterthur, Switzerland

[21] Appl. No.: 410,649

[22] Filed: Sep. 21, 1989

[30] Foreign Application Priority Data

Sep. 21, 1988 [DE] Fed. Rep. of Germany ..... 3832110

[51] Int. Cl.[5] ..... D01H 4/16; D01H 4/18

[52] U.S. Cl. ..... 57/401; 57/411

[58] Field of Search ..... 57/401, 408, 411, 413

[56] References Cited

U.S. PATENT DOCUMENTS

| | | | |
|---|---|---|---|
| 4,628,679 | 12/1986 | Stalder et al. | 57/401 |
| 4,651,516 | 3/1987 | Clough | 57/401 |
| 4,696,155 | 9/1987 | Stalder et al. | 57/401 |
| 4,697,410 | 10/1987 | Billner | 57/401 |
| 4,697,411 | 10/1987 | Artzt et al. | 57/401 |
| 4,819,421 | 4/1989 | Stalder et al. | 57/401 X |

FOREIGN PATENT DOCUMENTS

| | | |
|---|---|---|
| 0385283 | 8/1987 | Australia . |
| 0175862 | 4/1986 | European Pat. Off. . |
| 0206198 | 12/1986 | European Pat. Off. . |
| 0208274 | 1/1987 | European Pat. Off. . |
| 2714089 | 10/1978 | Fed. Rep. of Germany . |
| 3100531 | 11/1981 | Fed. Rep. of Germany . |
| 3114093 | 1/1982 | Fed. Rep. of Germany . |
| 3308250 | 9/1984 | Fed. Rep. of Germany . |
| 3528570 | 3/1986 | Fed. Rep. of Germany . |
| 3441493 | 5/1986 | Fed. Rep. of Germany . |

OTHER PUBLICATIONS

Stalder, Herbert, et al., DIE Bedutung der Garnzugkraft Beim Friktionsspinnen, Textilpraxis, International, 1987, Sep. pp. 1088–1091.

*Primary Examiner*—John Petrakes

*Attorney, Agent, or Firm*—Kenyon & Kenyon

[57] ABSTRACT

A friction spinning machine comprising a perforated roller (6) and an imperforate roller (19) is so designed that high-quality yarn can be produced in various sizes and with adequate strengths at a relatively high rate of output. The adjustment parameters necessary to solve this problem are specified in detail, more particulary those determining the position, orientation and shape of the fibre feed duct (5).

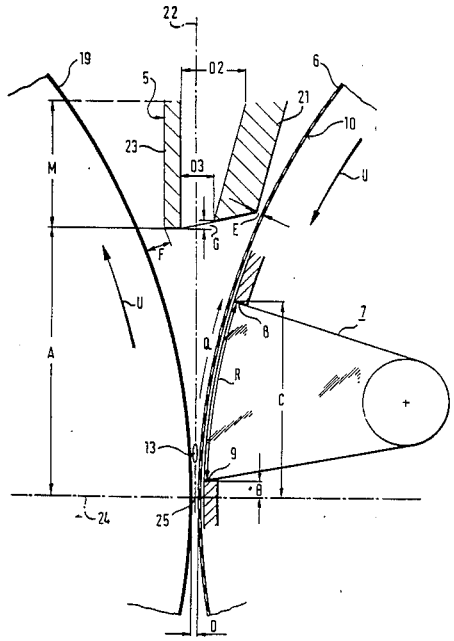

4 Claims, 2 Drawing Sheets